United States Patent [19]

Lanese

[11] 4,155,723

[45] May 22, 1979

[54] MATRIX WIRING SYSTEM FOR USE IN ELECTROSTATIC PRECIPITATORS

[75] Inventor: Philip M. Lanese, Belle Mead, N.J.

[73] Assignee: Belco Pollution Control Corporation, Parsippany, N.J.

[21] Appl. No.: 755,519

[22] Filed: Dec. 30, 1976

[51] Int. Cl.[2] ..... B03C 3/76

[52] U.S. Cl. ..... 55/112; 55/139; 361/166

[58] Field of Search ..... 55/13, 112, 139, 300; 173/2; 310/30; 318/122, 132; 361/139, 416, 166, 191; 335/255; 323/22 SC; 340/147 T, 166 SC

[56] References Cited

U.S. PATENT DOCUMENTS

| | | | |
|---|---|---|---|
| Re. 22,314 | 5/1943 | Dawson | 318/132 |
| 2,568,757 | 9/1951 | Mesh | 310/29 |
| 2,634,818 | 4/1953 | Wintermute | 55/112 |
| 3,307,050 | 2/1967 | Castle | 361/191 |
| 3,336,537 | 8/1967 | Reich | 331/116 M |
| 3,346,780 | 10/1967 | Klix | 318/132 |
| 3,504,480 | 4/1970 | Copcutt et al. | 55/112 |
| 3,535,692 | 10/1970 | Papke | 361/191 |
| 3,605,915 | 9/1971 | Gately et al. | 55/112 |
| 3,631,397 | 12/1971 | Mitsuhashi et al. | 361/191 |
| 4,075,433 | 2/1978 | Mitsuashi et al. | 340/166 S |

FOREIGN PATENT DOCUMENTS

| | | | |
|---|---|---|---|
| 593803 | 3/1960 | Canada | 55/112 |

*Primary Examiner*—Frank W. Lutter
*Assistant Examiner*—David L. Lacey
*Attorney, Agent, or Firm*—Marvin A. Naigur; John E. Wilson; John J. Herguth, Jr.

[57] ABSTRACT

A plurality of rappers which are periodically energized to clean the electrodes of electrostatic precipitators are connected by a wiring system which requires less wiring than conventional wiring systems. The rappers are arranged so that several have lead wires connected to a common power feed wire and these several have lead wires connected to a common power return wire.

3 Claims, 3 Drawing Figures

MATRIX WIRING SYSTEM FOR USE IN ELECTROSTATIC PRECIPITATORS

BACKGROUND OF THE INVENTION

Electrostatic precipitators which use a plurality of electrodes to remove particulate matter must be cleaned periodically during operation if they are to function with any reasonable efficiency. Otherwise, the electrode will become coated with the matter which has been removed from the air or other gas circulating through the precipitator and will no longer attract the particulate matter with any reasonable degree of efficiency.

A common way to clean the electrodes is to provide rappers which are mechanically connected with one or more electrodes. While the precipitator is in operation, each rapper is periodically operated to vibrate an electrode or electrodes causing the accumulated particulate matter to drop off. Each rapper is conventionally composed of a solenoid coil encircling a core which strikes an anvil when the solenoid is energized. The anvil is mechanically connected with one or more electrodes which are vibrated when the anvil is struck by the core.

Rectified AC current is conventionally used as current to energize the rappers. In the past it has been necessary to provide at least two wires between each rapper and an electrical or electronic control which selectively distributes the current to the rappers to energize them. This results in the use of much wiring which adds considerably to the cost of constructing the precipitator and the expenditure of much labor in installing the wiring for the rappers in the precipitator. Consequently, the installation of the rappers is a somewhat difficult and costly construction step.

SUMMARY OF THE INVENTION

It is an object of the present invention to overcome drawbacks in the prior art such as those discussed above. Accordingly, the rappers are arranged in a matrix comprising a plurality of power feed wires and a plurality of power return wires, each of the power return wires and power feed wires being connected at one end to means adapted to connect one of said power feed wires and one of said power return wires to a source of rectified AC current, a plurality of rapper solenoid coils, each of said coils being connected at one end to a power feed line and at the other end to a power return line, a plurality of series rectifiers, each of said series rectifiers being connected in series with one of said coils.

DETAILED DESCRIPTION OF THE PREFERRED EMBODIMENT

Figure 1:
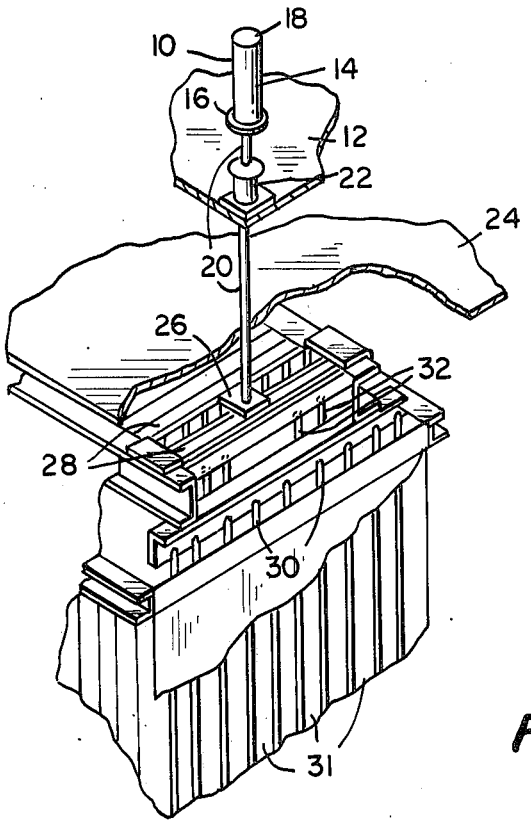
FIG. 1 is a fragmentary view, partly in section, of a portion of an electrostatic precipitator.

In FIG. 1 a rapper assembly 10 is shown mounted on the roof 12 of an electrostatic precipitator. The rapper assembly 10 includes an outer cylindrical cover 14 having an anvil 18 at its upper end. The rapper assembly 10 is mounted on top of a support rod 20 which extends down from the rapper assembly 10 through a vertical guide bearing 22 which is secured to the top of the roof 12. The rod 20 extends downward through the top of a ceiling 24 to a horizontal end plate 26. The end plate 26 is secured to several cross beams 28. From some of the cross beams 28 extend rod-like hangars 30 which support a number of flat electrodes 31 and from alternately spaced cross beams hang electrodes in the form of discharge wires 32. The wires 32 are connected to a source of electrical energy not shown as are the plates 31 according to standard practice. The electrical system used to energize the plates 31 and wires 32 is separate from that which energizes the rappers and which is described in detail below. Thus, if the rapper assembly can be energized so that its associated support rod 20 is vibrated, the support rod will vibrate one or more cross beams 28 which will convey the impulse to an electrode or electrodes connected with that cross beam.

Figure 2:
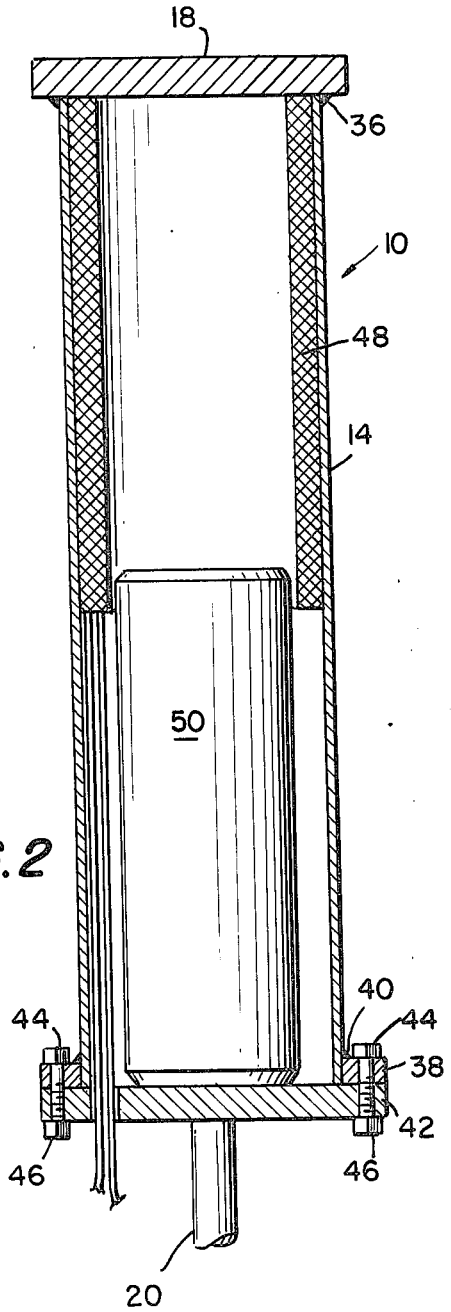
FIG. 2 is a view, partly in section, of a rapper assembly made in accordance with the present invention.

FIG. 2 shows in some detail a rapper assembly 10. As pointed out above, rapper assembly 10 has an outer cylindrical cover 14. The cylindrical cover 14 is closed at one end by the anvil 18 which is welded about its periphery at 36 to the top of the cover 14.

The other end of the cover 14 has a flange 38 which is welded at 40 to provide a means to secure an end closure 42 to that end. Bolts 44 project through the flange 38 and end closure 42 and have nuts 46 threaded on their ends to secure the end closure 42 to the flange 38.

A solenoid coil 48 fits snuggly within the cover 14 so that it is adjacent to the anvil 18. A ferro-magnetic core or plunger 50 is positioned within the coil 48 so that it can move axially. When the coil is energized, the ferromagnetic plunger is accelerated toward the anvil 18 to strike it. When the coil is de-energized the plunger drops against the end closure 42 and comes to rest. Thus, the anvil 18 receives the impulse transmitted by the moving plunger. The vibration caused by the collision between the plunger 50 and anvil 18 is transmitted through the rod 20 to one or more electrodes 31, 32 as previously explained.

Figure 3:
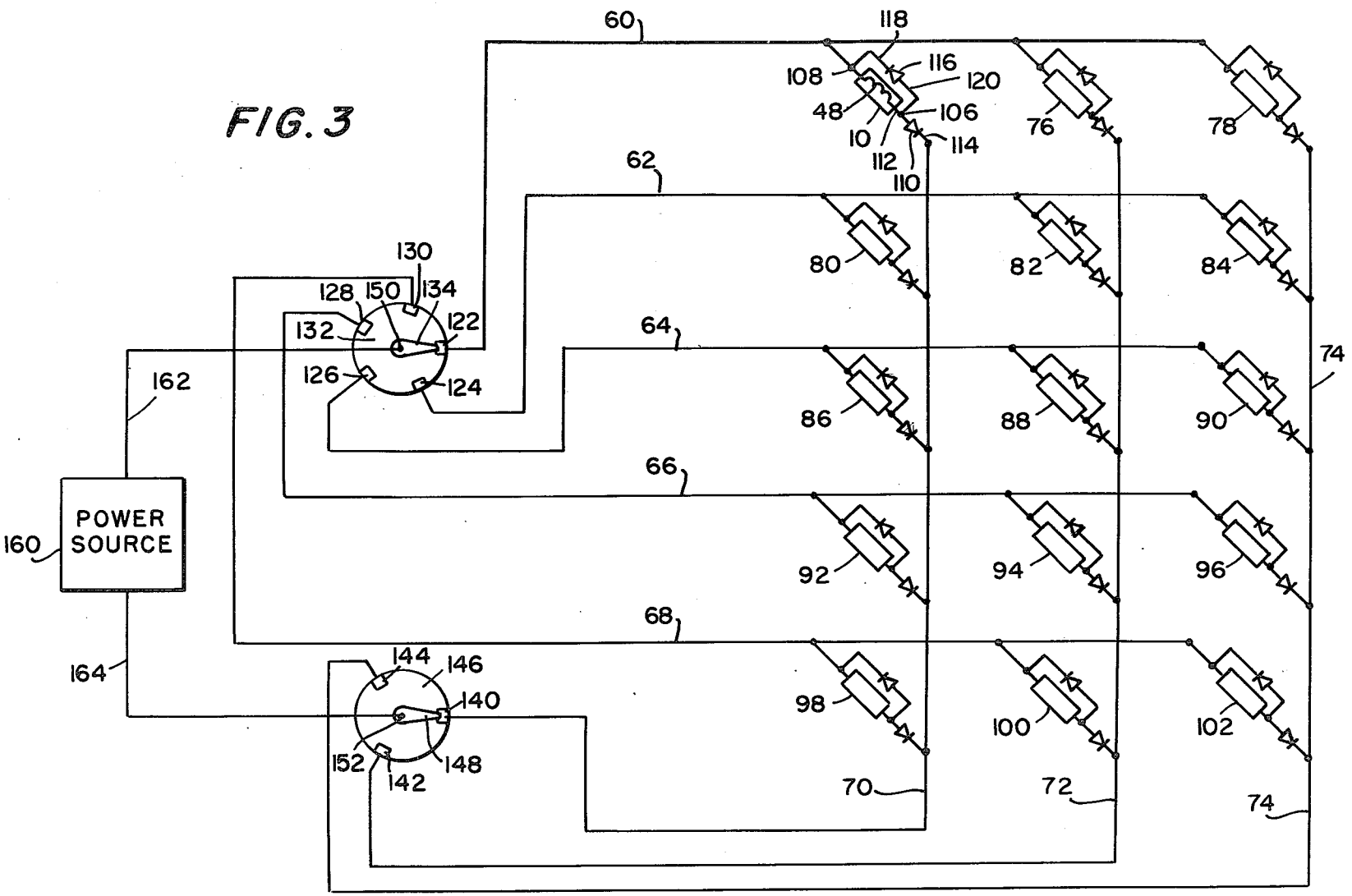
FIG. 3 is a schematic view showing a matrix wiring system made in accordance with the present invention.

FIG. 3 shows a matrix wiring system for use in energizing a plurality of rappers in an electrostatic precipitator. The matrix wiring system is made up of a plurality of power feed wires 60, 62, 64, 66 and 68 and a plurality of power return wires 70, 72 and 74. The matrix illustrated has only five power feed wires and three power return wires but it should be appreciated that in practice a larger number of power feed wires and power return wires could be used.

A plurality of rapper assemblies are connected to the matrix so that each coil thereof can be energized. Thus, the coil 48 of the rapper assembly 10 is connected between the power feed wire 60 and the power return wire 70. Similarly, the solenoid coils 76, 78, 80, 82, 84, 86, 88, 90, 92, 94, 96, 98, 100 and 102 of other rapper assemblies are each connected to the matrix. Thus, the coil 48 of the rapper assembly 10 along with the coils 76 and 78 are connected to the power feed wire 60 and the power return wires 70, 72 and 74 as shown. The coils 80, 86, 92 and 98 are connected to the power return wire 70 and are connected respectively to the power feed wires 62, 64, 66 and 68. The connection of the remaining coils to the power feed wires and power return wires is similar to those already described, that is, each coil is connected between a power feed wire and a power return wire so that each coil shares a power feed with two other coils and a power return with four other coils. It should be understood that any reasonable number of coils could be used in a matrix and a power feed could be connected to any reasonable number of coils as could a power return wire. The rapper assemblies will ordinarily be arranged in a matrix such as that shown in FIG. 3 because the electrodes they vibrate are in the form of parallel plates suspended below them. It is possible, however, that the rappers could be spaced in any mechanically convenient arrangement to vibrate the electrodes. The specific arrangement of rapper assemblies would depend on the arrangement of electrodes and the design of the structure which transmits the vibration from the rapper assemblies to the electrodes.

Each solenoid coil is connected with two rectifiers in an identical manner. Thus, for clarity, only one coil will be described with respect to its two associated rectifiers.

Thus, the coil 48 of the rapper assembly 10 is connected between two junctions 106 and 108. A series rectifier 110 is connected to the junction 106 and the power return wire 70 by lines 112 and 114, respectively. A rectifier 116 is connected to the junction 108 by a wire 118 and to the junction 106 by the wire 120.

The power feed wires 60, 62, 64, 66 and 68 are connected respectively to terminals 122, 124, 126, 128 and 130 of a distributor 132 which has a rotor 134. Similarly, the power return wires 70, 72 and 74 are connected to the terminals 140, 142 and 144 of a distributor 146 which has a rotor 148. The rotor 134 of the distributor 132 is pivoted at 150 so that an end of the rotor 134 can rub against the terminals 122, 124, 126, 128 and 130 as it rotates. Similarly, the rotor 148 of the distributor 146 is pivoted at 152 so that it will rub against the terminals 140, 142 and 144 as it rotates. A source of rectified AC current 160 is connected by a wire 162 to the pivot 150 and to the pivot 152 by a wire 164 so that current will flow from the power source 160 out through the wire 162 and return to the power source 160 through wire 164.

Thus, when the rotor 134 is turned so that it engages the terminal 122, and the rotor 148 is turned so that it engages the terminal 140, the current from the power source 160 will flow through the power feed 162, the rotor 134, the terminal 122 and the power feed wire 60 and current in the power return wire 70 can flow through the terminal 140, the rotor 148, the pivot 152 and the wire 164 to the power source 160. When the rotors are in this position, that is, the position shown in FIG. 3, solenoid coil 48 will be energized.

Similarly, when any power feed line and power return line are placed in communication with the power source 160, the coil connected between that power feed line and power return line will be energized and no other coil will be energized. This is so because of the series rectifiers which are associated with each coil. Thus, if the coil 82 was not in series with a series rectifier 170, current from the power feed wire 60 could flow through the coil 76 down the power return line 72 through a lead wire 172, the coil 82 and wire 174 to the power feed wire 62 which would energize the coil 80 which is connected between the power feed wire 62 and the power return wire 70. If the coil 84 was not associated with a series rectifier, current from the power feed wire 60 would flow through the coil 78, the power return wire 74 and flow through the coil 84 to the power feed wire 62 and through the coil 80 to the power return wire 70. Thus, the first two horizontal rows of coils have been shown to be energized and if the remaining coils are considered it will be readily apparent that they too would be energized upon the supply of electrical current to the power feed wire 60 or for that matter any power feed wire. This would not be acceptable in practice where all of the power is to be made available at only one coil at a time to insure sufficient energy to vibrate the electrodes with sufficient vigor.

Conventionally, as already explained, two separate power leads extend from one or more switching devices, such as the present distributors to each rapper coil. The disadvantages of providing two power leads have already been explained.

It has been found that when the current to any of the coils is interrupted an induced electromotive force is generated which causes current to continue to flow through the coil. This causes destruction of the switching device. In the illustrated embodiment arcing at the contacts of the distributors 132 and 146 would cause the rotors and contacts to deteriorate. To prevent this, each of the present coils is placed in parallel with a parallel rectifier which is connected between two junctions, one junction being between the series rectifier and the coil. Thus, when either or both of rotors 134 and 148 disengage with the contacts 122 and 140, current induced within the coil 48 will not flow out into the power return wire 70. It will take the path of least resistance to flow, that is, through the wire 120, parallel rectifier 116 and the junction 108 and back through the coil 48. Thus, the induced current will continue to flow until dissipated within the coil in which it was induced and therefore, will not damage the switching mechanisms.

The series rectifier and the parallel rectifier associated with each coil must be arranged properly if only one coil is to be energized at a time and if the current induced within the coil upon discontinuation of its energization current is to be dissipated. Specifically, taking the coil 48 in the rapper assembly 10 as illustrative, if the junction 108 is termed the first junction and the junction 106 is termed the second junction, the series rectifier is arranged so that current passing through it can pass only from the first junction to the second junction while passing through the coil whereas the parallel rectifier 116 is connected between the junctions to permit current flow from the second junction through the parallel rectifier 116 to the first junction. Such an arrangement will allow the present matrix system to permit energization of only one coil at a time through a matrix of comparatively few wires while at the same time preventing deterioration of the device used to discontinue the feed of electric current to the coils.

The foregoing describes but one preferred embodiment of the present invention, other embodiments being possible without exceeding the scope thereof.

What is claimed is:

1. A vibration and control system for use in electrostatic precipitators comprising:

a plurality of power feed wires;

a plurality of power return wires;

a plurality of rappers, each having a coil and a series rectifier connected in series with said coil, said plurality of rappers consisting of several groups of rappers with the rappers of each of said groups all being connected to only one of said power feed wires and each of said rappers being connected to only one of said power return wires, each of said rappers being connected between only one of said power feed wires and only one of said power return wires with said series rectifiers all being connected to said coils such that current flows through said coils only from said power feed wires to said power return wires, and each of said rappers further comprising a parallel rectifier connected in parallel with said coil between the associated power feed line and the associated power return line, said parallel rectifier being arranged to allow current to pass through said parallel rectifier only from the end of said coil in communication with said power return line to the end of said coil in communication with said power feed line;

power source for supplying rectified AC current;

first switching device connected between said power source and said power feed wires to allow current to flow from said power source selectively to one of said power feed wires; and a second switching device connected between said power source and said power return wires to allow current to flow selectively from one of said power return wires to said power source;

whereby, when said first switching device and said second switching device are operated, one of said power feed wires and one of said power return wires will be placed in communication with said power source and only the coil connected between said one power feed wire and said one power return wire will be energized.

2. The system defined in claim 1 wherein said power feed wires are in parallel.

3. The system defined in claim 2 wherein said power return wires are in parallel.

* * * * *